United States Patent [19]

Sawicky

[11] Patent Number: 5,042,798

[45] Date of Patent: Aug. 27, 1991

[54] UPPER BODY AEROBIC TRAINING MACHINE

[76] Inventor: Michael Sawicky, 1300 C Natchez Trace, Marietta, Ga. 30060

[21] Appl. No.: 445,265

[22] Filed: Dec. 4, 1989

Related U.S. Application Data

[62] Division of Ser. No. 221,942, Jul. 20, 1988, abandoned.

[51] Int. Cl.[5] ..... A63B 21/04; A63B 21/018

[52] U.S. Cl. ..... 272/136; 272/72; 272/130

[58] Field of Search ..... 272/116, 118, 130, 72, 272/134, 136, 72.3, 144

[56] References Cited

U.S. PATENT DOCUMENTS

| | | | |
|---|---|---|---|
| 1,279,633 | 9/1918 | Allen . | |
| 3,558,130 | 1/1971 | Anderson . | |
| 3,586,322 | 6/1971 | Kverneland . | |
| 3,731,922 | 5/1973 | Jungreis . | |
| 4,249,725 | 2/1981 | Mattox . | |
| 4,396,188 | 8/1983 | Dreissigacker et al. | 272/72 |
| 4,441,706 | 3/1984 | Korzaniewski | 272/180 |
| 4,537,396 | 8/1985 | Hooper | 272/130 |
| 4,580,983 | 4/1986 | Cassimi et al. . | |
| 4,743,011 | 5/1988 | Coffey | 272/72 |

*Primary Examiner*—Richard J. Apley
*Assistant Examiner*—Jerome Donnelly
*Attorney, Agent, or Firm*—Schmeiser, Morelle & Watts

[57] ABSTRACT

This tower-like machine is operated in the vertical mode, the user pulling a grip bar downwardly from overhead and continuing the movement to press down below the waist and thereby drive a fan-bladed free wheel journaled in the machine frame through a pulley and chain assembly resiliently opposing downward travel of the grip bar.

7 Claims, 3 Drawing Sheets

UPPER BODY AEROBIC TRAINING MACHINE

This application is a continuation of application Ser. No. 07/221,942, filed July 20, 1988, now abandoned.

FIELD OF THE INVENTION

The present invention relates generally to the user-operated exercising machine art and is more particularly concerned with a novel multipurpose aerobic training machine of compact design and lightweight construction.

BACKGROUND OF THE INVENTION

In response to long standing demand for user-operated exercising devices suitable particularly for home use, a variety of equipment has been devised, developed and marketed. Rowing machines, stationary cycles, treadmills and weight lifting and pulling device installations have proven to be the most popular types over the years. None of them, however, satisfies the ideal of a multipurpose device of size readily accomodated in the average family residence and of lightweight construction capable of withstanding the most rigorous service. Rowing machines and treadmills typically require considerable floor space and present difficult storage problems. Weight lifting and pulling apparatus generally require installation which is expensive and necessitates a permanent commitment of room space. Moreover, all such equipment, and stationary cycles as well, lack versatility in that they do not afford opportunity for development of slow-twitch muscle fibers to increase endurance strength. Instead, the prior art has been only or mainly concerned with the development of muscles of the legs, back or arms or all of those relatively powerful muscles.

SUMMARY OF THE INVENTION

In accordance with this invention based on the novel concepts set out below, an aerobic training machine is provided which is useful for cardiovascular conditioning and upper body muscular development. Thus, in contrast to the prior art, this new machine is operated in the vertical mode and the user's upper body muscles are involved in pulling downwardly from overhead and continuing the movement to press down below the waist. At the same time, hand gripping muscles are exercised as the user maintains a firm hold of a grip bar throughout the length of vertical travel from full overhead reach to complete downward or finger tip extension. As special features of this machine, the work load range is selectable and resistance is proportional is applied force so that the work load is dynamically adjusted over the whole range of stroke and continuously throughout the workout period.

Additional important advantages of the machine of this invention include the fact that it is light in weight to allow for easy moving, storage and transportation. It is, nevertheless, strong and stable enough for the most rugged service requirements and further requires relatively little floor space for both operation and storage.

One of the novel concepts underlying this invention is to provide the desired mechanical load by relatively light-weight means in the form of a freewheel. Another important concept is to mount that wheel for rotation in a vertical plane in a tower-like frame in which it is oriented radially from side to side of the frame. Still another of these new ideas is to construct the frame as a relatively tall open structure of relatively small base which will withstand forces applied in driving the wheel through operating mechanism carried by the frame standing in fixed upright position.

These concepts are implemented in accordance with this invention by securing tie members to long stringers spaced apart and parallel to each other with the freewheel mounted in a plane parallel to the axis of the shape-maintaining tower-like frame. In this structure the wheel circumference is greater than the frame transverse dimension. The frame is a welded construction of tubular steel stringers as main members and tie beams and struts and the wheel is a bicycle wheel with fan blades mounted on the spokes to provide the required air resistance in exercising use of the equipment. A base including several legs is secured to the frame for the double purpose of providing an enlarged base area and of increasing the overall height of the machine.

The grip bar or operating handle of this machine is a cylinder of diameter requiring continual effort by the user to maintain an effective grip. Further, the grip bar is disposed with its axis horizontal and is so maintained as it is moved in a vertical plane in front of the frame as the user stands close to the machine during operation, the front stringers of the frame then serving as guides for travel of the grip bar.

The freewheel is operatively connected to the grip bar by an assembly of lines and pulleys so that the grip bar is biased to top position and the freewheel is rotated as the grip bar is pulled down from the topmost position and then pressed toward the the lowermost position. The rate of rotation and consequently the rate of energy expense are in direct proportion to the rate of downward travel of the grip bar.

In operating this unique machine, the user stands close to it facing the freewheel so that as the operator pulls down and then pushes down or presses the grip bar, he is cooled by the action of freewheel fan. Also, as indicated above, such exercise involves muscles not used substantially in prior art equipment operation, particularly that requiring pulling inward in a horizontal direction or that involving mainly use of the legs, as in bicycling.

Briefly described, the present invention comprises an upright open frame including a plurality of stringers and tie members secure to the stringers and holding them together in rigid shape maintaining tower structure, a fan-bladed free-wheel journaled in the frame for rotation in a substantially vertical plane, and means including a grip bar for operating the machine by rotating the wheel including a sprocket connected to the freewheel and a roller chain engaging the sprocket and connected to the grip bar.

DETAILED DESCRIPTION OF THE DRAWINGS

Those skilled in the art will gain a further and better understanding of the present invention upon consideration of the drawings accompanying and forming a part of this specification, in which.

DETAILED DESCRIPTION OF THE INVENTION

Figure 1:
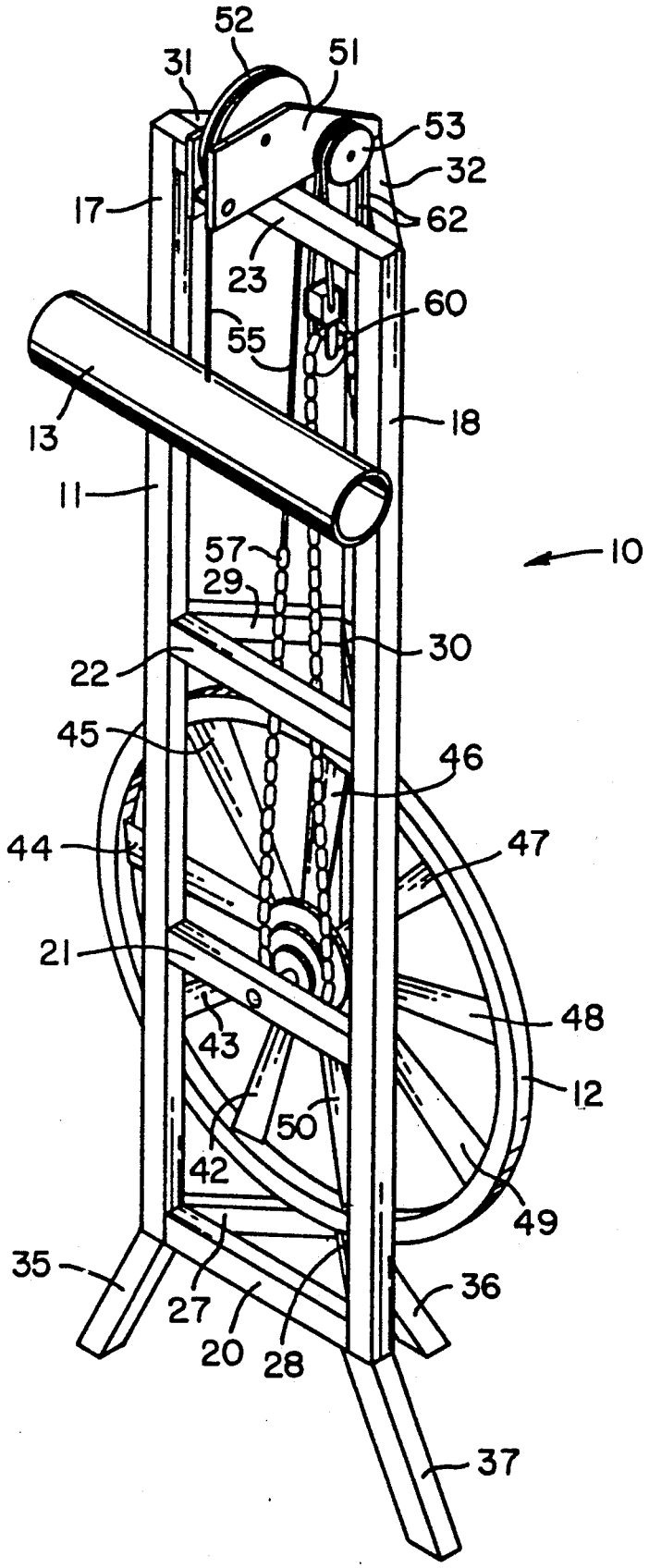
FIG. 1 is a perspective view in elevation of a machine of this invention including a tripod base and a pulley assembly at the top.
Figure 3:
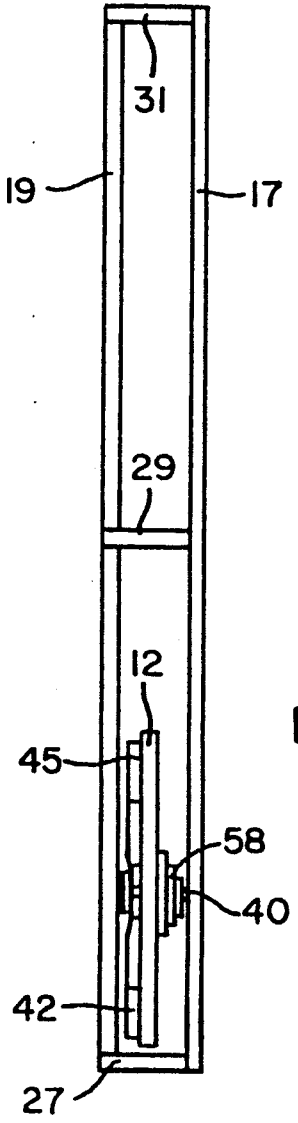
FIG. 3 is a fragmentary side elevational view of the FIG. 1 machine showing the relationship of the freewheel to the frame.
Figure 2:
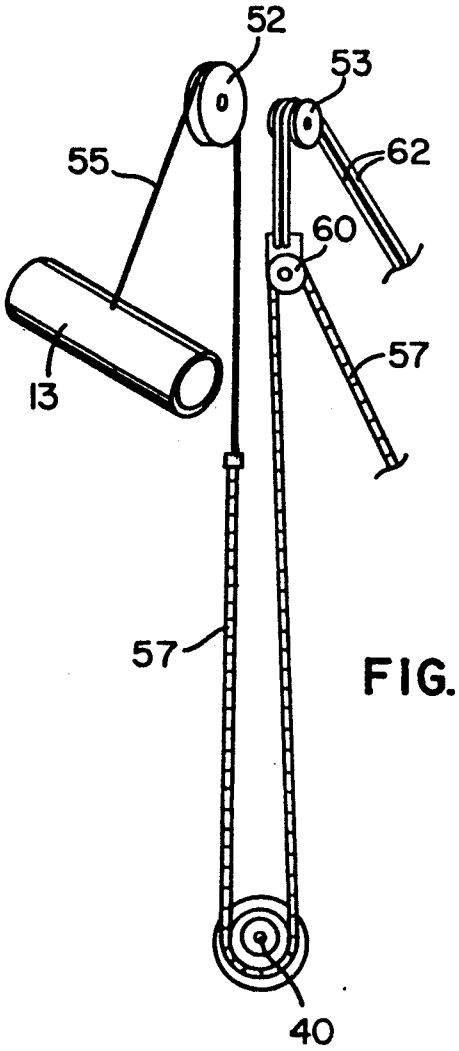
FIG. 2 is a fragmentary side elevational view of the FIG. 1 machine showing the line and pulley combination apart from the frame the freewheel and pulley support structure.
Figure 4:
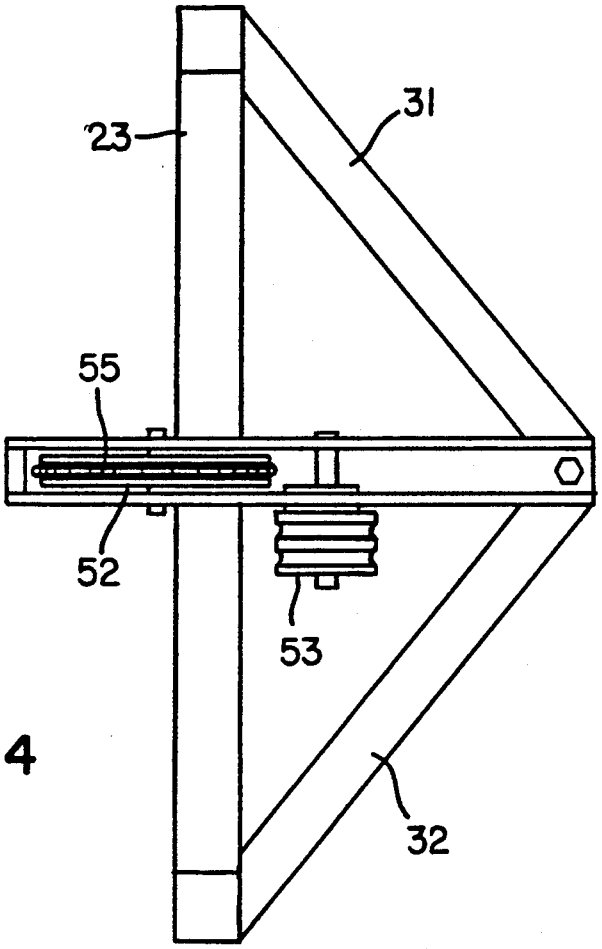
FIG. 4 is a top plan view of the pulley assembly of the FIG. 1 machine.
Figure 5:
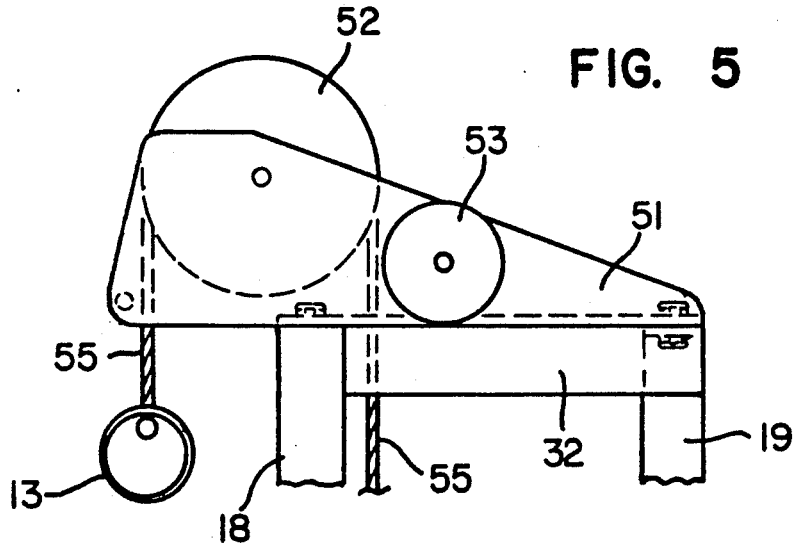
FIG. 5 is a fragmentary side elevational view of the top portion of the FIG. 1 machine showing the pulley assembly bolted to the frame.

As a preferred embodiment of this invention, machine 10 illustrated in these drawings comprises a tower-like frame 11 of welded construction, a freewheel 12 journaled for rotation in a vertical plane in the lower part of frame 11, a grip bar 13 and a line and pulley assembly 14 carried by frame 11 operatively connecting grip bar 13 to freewheel 12. Frame 11 is constructed of one inch-square, 16 gauge, steel tubing in the form of three main 74 inch-long stringers 17, 18 and 19 secured in parallel spaced relation to provide a triangular tower configuration with two front stringers 17 and 18 secured to each other by four 11 inch-long tie bars 20, 21, 22 and 23. Rear stringer 19 is secured to the front stringers by six 8 ½ inch-long struts 27, 28, 29, 30, 31 and 32.

A stable tripod base for frame 11 is provided by three bolt-on legs 35, 36, and 37, increasing the base and stability of the machine and the overall height of the frame.

Freewheel 12 is a bicycle wheel having an axle 40 mounted horizontally between the lower-most tie bar 23 and rear strut 19 where it is journaled in bearings (not shown). Nine 3 inch-wide, 8 inch-long fan blade 42–50 of 0.30 inch thick flexible polyvinyl chloride plastic in uniform spaced relation are secured to spokes of the wheel.

Line and pulley assembly 14 includes a bolt-on subassembly including an open box-like frame 51 and pulleys 52 and 53 which are mounted for rotation with their axes horizontal, usual bearings being provided for journaling these components. Pulley 52 is of four inch-diameter and has a ⅛ inch groove while pulley 53 has two 5/16 inch groves and is two inches in diameter. These two pulleys are radially oriented front to back and vertically with respect to frame 11.

A 65 inch-long, or ⅛ inch diameter steel cable 55 is run over the top of pulley 52 one end of cable 55 being secured to and supporting grip bar 13 of 20 inch-long 4 ½ inch diameter polyvinyl chloride plastic tubing. The other end of the cable is attached to one end of an 8 foot length of roller chain (bicycle chain) 57 which runs around sprocket 58 freewheel axle 40 and runs back up over a floating pulley 60 and then down to an anchor point on stringer 19.

An elastic cord 62 is secured at one end to the lower part of stringer 19 and is run over pulley 53 at the top of the frame and attached to floating pulley 60 to supply constant tension for roller chain 57. Thus downward movement of floating pulley 60 feeds roller chain 57 as grip bar 13 is pulled down, freewheel 12 changing the linear travel of grip bar 13, cable 55 and chain 57 to rotational movement of the bicycle wheel. Elastic cord 62 provides tension to retract chain 57, cable 55 and grip bar 13 returning the mechanism to top of the stroke starting position.

I claim:

1. A user operated, upper body, aerobic training machine comprising:

a) an upright open frame including a plurality of spaced elongated stringers and tie members secured to the stringers and tying them together in a rigid, shape-maintaining, free-standing tower structure;

b) a fan-bladed freewheel oriented radially from side to side of the frame and journaled in the lower part of the frame for rotation in a substantially vertical plane;

c) sprocket means including a sprocket secured to the freewheel for rotation therewith;

d) a roller chain engaging the freewheel sprocket and attached at one end to the frame;

e) freewheel operating means including a grip gar and a cable connecting the grip bar to the other end of the roller chain, the grip bar being disposed for travel vertically in front of the frame in a plane substantially parallel to the plane of rotation of the freewheel as the user grips and pulls down and presses in using the machine for exercise;

f) and resilient roller chain tensioning means including a vertically movable floating pulley in the upper part of the frame above the freewheel supporting the roller chain between the freewheel and the frame and an elastic cord attached at one end to the floating pulley and at the other end to the frame.

2. The machine of claim 1 in which a stationary pulley mounted on the frame above the floating pulley supports the elastic cord between the floating pulley and the frame.

3. The machine of claim 1 including a stationary cable support member on the frame above both the grip bar and the roller chain.

4. The machine of claim 3 in which the grip bar is a plastic tube and the stationary cable support member is a pulley.

5. The machine of claim 4 including a base assembly comprising a plurality of legs secured to the lower end of the frame to support the tower structure in stable upright position during use.

6. The machine of claim 5 in which the tower structure height to width ratio is about 15 to 1.

7. The machine of claim 6 in which the base comprises three individual legs separately bolted to the lower end of the frame and extending downwardly and outwardly and substantially increasing total height of the machine while stabilizing the tower structure against lateral forces imposed during exercising use of the machine.

* * * * *